US009567145B1

(12) United States Patent
Patalano

(10) Patent No.: US 9,567,145 B1
(45) Date of Patent: Feb. 14, 2017

(54) SUSTAINABLE PACKAGING APPARATUS

(71) Applicant: Alex Patalano, Huntington Beach, CA (US)

(72) Inventor: Alex Patalano, Huntington Beach, CA (US)

( * ) Notice: Subject to any disclaimer, the term of this patent is extended or adjusted under 35 U.S.C. 154(b) by 0 days.

(21) Appl. No.: 14/946,556

(22) Filed: Nov. 19, 2015

(51) Int. Cl.
*A45F 5/00* (2006.01)
*B65D 71/06* (2006.01)
*B65D 71/52* (2006.01)

(52) U.S. Cl.
CPC ..... *B65D 71/06* (2013.01); *B65D 71/0003* (2013.01)

(58) Field of Classification Search
CPC ... B65D 71/06; B65D 71/0003; B65D 71/125; B65D 75/527; B65D 71/00; B65D 81/36; B65D 5/029; B65D 5/2033; B65D 5/5445; B65D 5/5475; B65D 71/0011
USPC ..... 294/141, 160; 206/162, 192, 427, 429, 206/431; 229/103, 110, 235
See application file for complete search history.

(56) References Cited

U.S. PATENT DOCUMENTS 1,864,968 A * 6/1932 Weiner ..... B65D 5/5445 229/103
1,930,236 A * 10/1933 Fox ..... B65D 5/5023 206/427
2,892,540 A * 6/1959 Tupper ..... B65D 77/04 206/427
2,973,129 A 2/1961 Campbell et al.
3,263,900 A * 8/1966 Link ..... B65D 5/542 229/120.09
3,659,707 A 5/1972 Nilsson et al.
4,815,599 A 3/1989 Schuster
4,856,652 A * 8/1989 Bowland ..... B65D 71/00 184/1.5
5,052,557 A * 10/1991 Contino ..... B65D 75/245 206/142
5,215,208 A * 6/1993 Jackson ..... A47B 73/006 206/427
5,542,537 A * 8/1996 Ford ..... B65D 77/042 206/431
5,901,847 A * 5/1999 Colby ..... B65D 71/063 206/427
6,715,639 B2 4/2004 Spivey
7,311,201 B2 * 12/2007 Lo ..... B65D 15/04 206/427

(Continued)

OTHER PUBLICATIONS

Yee, Bryant, "Redesigning LED Packaging," Thesis Project, 2011, [online], [retrieved on Nov. 19, 2015], retrieved from the internet:<URL: http://bryantyeedesign.com/pages/work/redesigning-led-packaging.html>, 10 pages.

(Continued)

*Primary Examiner* — Gabriela Puig

(57) ABSTRACT

A sustainable packaging apparatus comprising repurposable components is disclosed. A sustainable packaging apparatus having a cellular structure, comprised of a plurality of compartments, provides packaging for the shipment of objects such as beverage canisters. The plurality of compartments can each be separated into vessel portions. The two vessel portions of the compartments are designed to function as vessels after the objects are removed from the compartments. The vessel portions of the sustainable packaging apparatus are ideal for use as cups or game pieces; thus, the vessel portions maintain utility after shipment of the objects.

18 Claims, 10 Drawing Sheets

(56) References Cited

U.S. PATENT DOCUMENTS

| | | | | |
|---|---|---|---|---|
| 7,870,957 | B2 * | 1/2011 | Holley, Jr. | B65D 5/48038 206/427 |
| 8,608,015 | B2 | 12/2013 | Wolf et al. | |
| 2006/0255105 | A1 * | 11/2006 | Sweet | B65D 5/0005 229/101.2 |
| 2007/0007158 | A1 * | 1/2007 | Cordes | B65D 71/0085 206/431 |
| 2010/0102110 | A1 * | 4/2010 | Learn | B65D 5/0209 229/106 |
| 2010/0176187 | A1 * | 7/2010 | Shaboo | B65D 5/46096 229/110 |
| 2013/0069311 | A1 | 3/2013 | Pryor | |

OTHER PUBLICATIONS

The Packaging Insider, Packaging Design, Trends and Technology, 2014, [online], [retrieved on Nov. 19, 2015], retrieved from the internet:<URL: http://thepackaginginsider.com/nectar-beer-in-hexagonal-cans/>, 3 pages.

* cited by examiner

SUSTAINABLE PACKAGING APPARATUS

BACKGROUND

As populations increase, waste is becoming a more significant environmental issue. For example, in 2013, consumers discarded 75.8 million tons of containers and packaging. The amount discarded comprised 29.8 percent of the total municipal solid waste generated in the United States according to the EPA. http://www.epa.gov/solidwaste/nonhaz/municipal/pubs/2013_advncng_smm_rpt.pdf.

For example, beverage manufacturers ship and sell beverages in containers that are further disposed in a package for transportation and distribution. Once purchased, consumers discard the package used to ship the beverage container and the waste contributes to the millions of tons of municipal solid waste generated annually. Prior to consumption, consumers may also transfer the liquid from the original container to separately purchased cups for drinking. The separately purchased cups are often disposable and also contribute to the municipal solid waste generated annually.

Thus, there is a need for new packaging apparatuses that can reduce the proliferation of waste generated by current options.

Embodiments of the present invention address these and other problems, individually and collectively.

BRIEF SUMMARY

Embodiments of the present invention relate to a sustainable and repurposable packaging apparatus. In some embodiments, the packaging apparatus is characterized by a "cellular" design including multiple compartments capable of enclosing a container, such as one or more beverage-filled containers (e.g., cans, bottles, or the like). In some embodiments, the compartments can be separable to form vessel portions that can be used as containers for holding. For example, the vessel portions may be used as cups for retaining a liquid. Thus, the components of the packaging apparatus may be repurposed as cups after completing transportation of the beverages.

In some embodiments, as described in further detail below, the packing apparatus can also be utilized as part of a beverage-related game involving multiple players. Various embodiments of the disclosed packaging are contemplated and not limited to the shapes, sizes, or numbers of compartments as described herein. The present disclosure is limited to beverages for purposes of discussion but one of skill in the art will understand that some embodiments may also encompass non-liquid products.

One embodiment of the invention is directed to a packaging apparatus comprising a sleeve structure, a plurality of compartments disposed within the sleeve structure, and a handle assembly affixed to the sleeve structure. Each of the plurality of compartments may include a first vessel portion, a second vessel portion, and a separation element configured to decouple the first vessel portion from the second vessel portion.

DETAILED DESCRIPTION

Embodiments of the present invention are directed towards a repurposable packaging apparatus comprising a plurality of components that can be used for alternate purposes. A repurposable packaging apparatus reduces the amount of packaging added to the municipal solid waste stream. In particular, the embodiments of the sustainable packaging apparatus disclosed are directed to cellular packaging. The integrity of the cellular package is maintained by a sleeve structure. The cells are configured to hold a plurality of compartments. Each compartment may be manufactured with a separation element. Opening the canister along the separation element may provide access to an object disposed within the compartment (e.g., a beverage container). Opening the compartment along the separation element may create one or two vessels, depending on placement of the separation line. After separation and removal of the contents, the vessels can be used for a variety of purposes including but not limited to beverage consumption and playing games like "beer pong" and "flip-cup".

Figure 1:
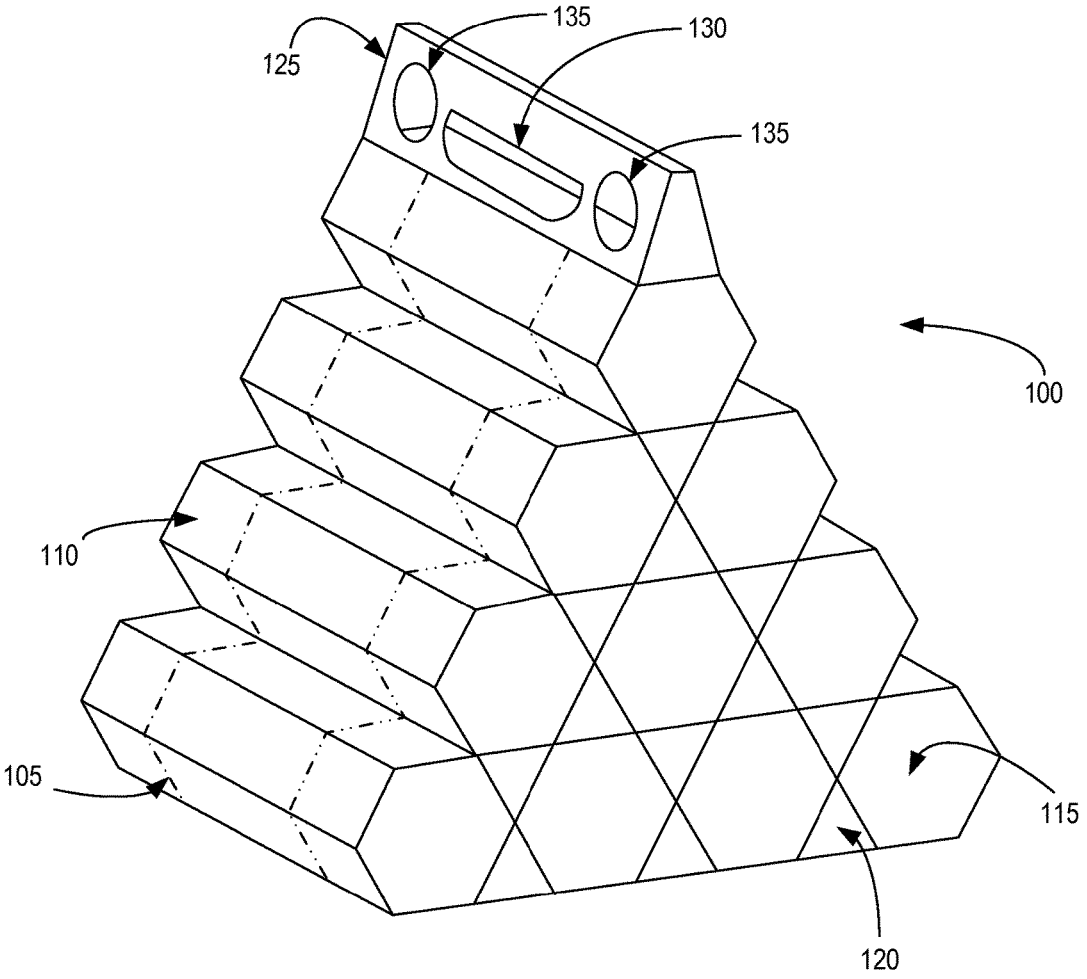
FIG. 1 illustrates an exemplary packaging apparatus according to an embodiment of the invention.

FIG. 1 illustrates an exemplary packaging apparatus 100 according to an embodiment of the invention. The packaging apparatus 100 may include a plurality of compartments 110. In some embodiments, the plurality of compartments may be supported by a sleeve structure 105. In some embodiments, the sleeve structure 105 may support a cellular structure and maintains the position of a plurality of compartments 110. As depicted in FIG. 1, the sleeve structure 105 may support the plurality of compartments 110 into a pyramidal formation. In other embodiments, the sleeve structure 105 may support the plurality of compartments 110 in other formations.

In some embodiments, the sleeve structure 105 may be formed using rigid or semi-rigid materials including paper, plastic film, foil, cellulose, or some combination or composite thereof. The sleeve structure 105 may be a single structure that partially surrounds the plurality of compartments 110 as indicated by the dashed lines in FIG. 1. In other embodiments, the sleeve structure 105 may completely surround the plurality of compartments 110.

The top surface and the bottom surface of the plurality of compartments 110 may be manufactured to form a planar surface 115. The planar surface 115 may also include a plurality of triangular tabs 120. First surfaces of the plurality of compartments 110 and the triangular tabs 120 may form a first continuous planar surface 115 for a first side of the packaging apparatus 100. Similarly, second surfaces of the plurality of compartments 110 opposite to the first surfaces of the plurality of compartments 110 may form a second continuous planar surface for a second side of the packaging apparatus 100.

In some embodiments, each of the triangular tabs 120 may be affixed to at least one of the plurality of compartments 110. In other embodiments, each of the triangular tabs 120 may be removed from the plurality of compartments 110. In such embodiments, the triangular tabs 120 may be perforated along the connections to the plurality of compartments 110 to allow the triangular tabs 120 to be separated from the plurality of compartments 110. In some embodiments, the planar surface 115 created by the plurality of compartments 110 and the triangular tabs 120 may contain printed labels, instructions, advertisements, or other marketing materials.

In some embodiments, the packaging apparatus 100 may include a handle assembly 125. In some embodiments, the handle assembly 125 may be attached to the sleeve structure 105 to assist with carrying the packaging apparatus 100. The handle assembly 125 may include a hand grip portion 130 and one or more recess portions 135. In some embodiments, the hand grip portion 130 may be configured to allow a portion of a hand to pass through the hand grip portion 130. In some embodiments, the recess portions 135 may be opening in the handle assembly 125. In some embodiments, the recess portions 135 may be a chamber, cavity or pocket with the handle assembly 125. In some embodiments, the recess portions 135 may be formed to hold a spherical-shaped item (e.g., a ping-pong ball).

Figure 2:
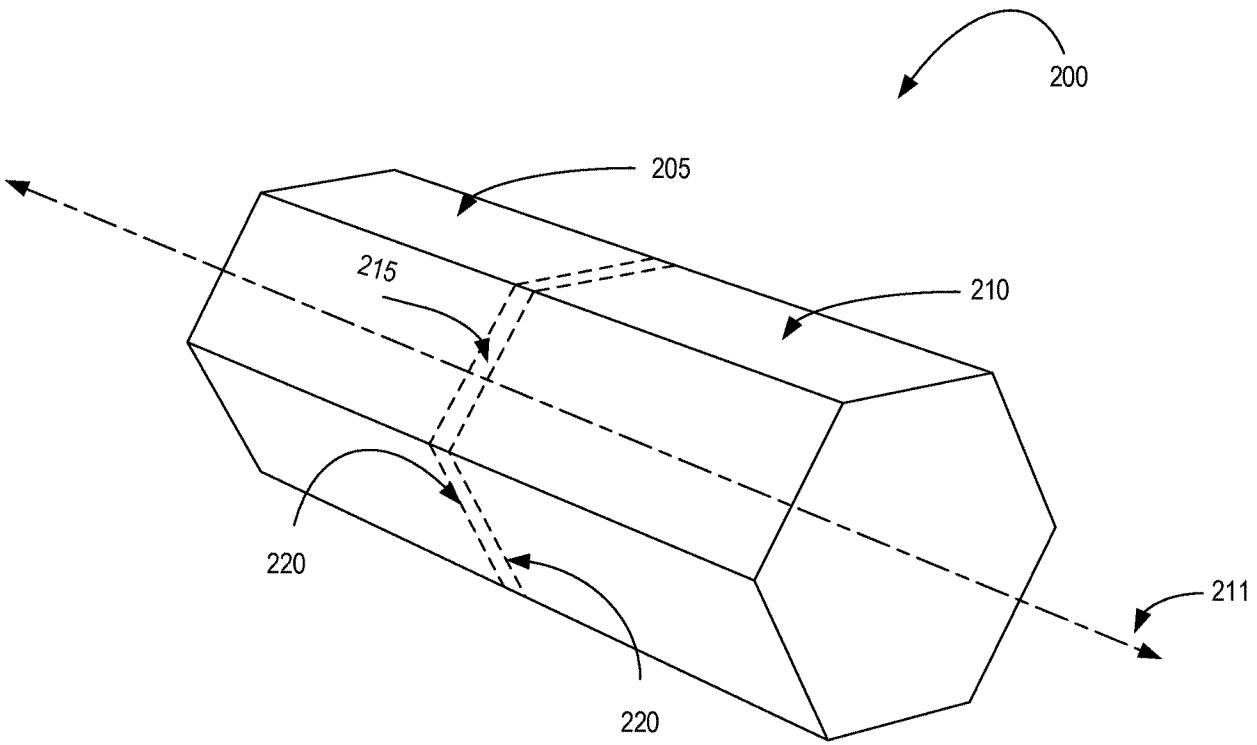
FIG. 2 illustrates a structure of a compartment according to an embodiment of the invention.

FIG. 2 illustrates a structure of a compartment 200 according to an embodiment of the invention. The compartment 200 can be formed using, rigid or semi-rigid materials including paper, plastic film, foil, cellulose, or some combination or composite thereof. In some embodiments, the compartment 200 may be composed of a material that allows for reuse of the compartment.

The compartment 200 may include a first vessel portion 205 and a second vessel portion 210. In some embodiments, the first vessel portion 205 and the second vessel portion 210 may be joined by a separation element 215, or along a single separation line. The separation element 215 can be disposed as desired along the longitudinal axis 211 of the compartment 200. The size of the separation element 215 relative to the size of the compartment 200 may vary.

The separation element 215 can be configured to decouple from the first and second vessels along separation lines 220. For example, the separation element 115 may include a tabbed portion to allow for separating the first vessel portion 205 and the second vessel portion 210 along the separation lines 220. In some embodiments, the separation lines 220 may by perforated, scored, glued using an adhesive, or secured in a manner as would be understood by one of ordinary skill in the art.

Figure 3:
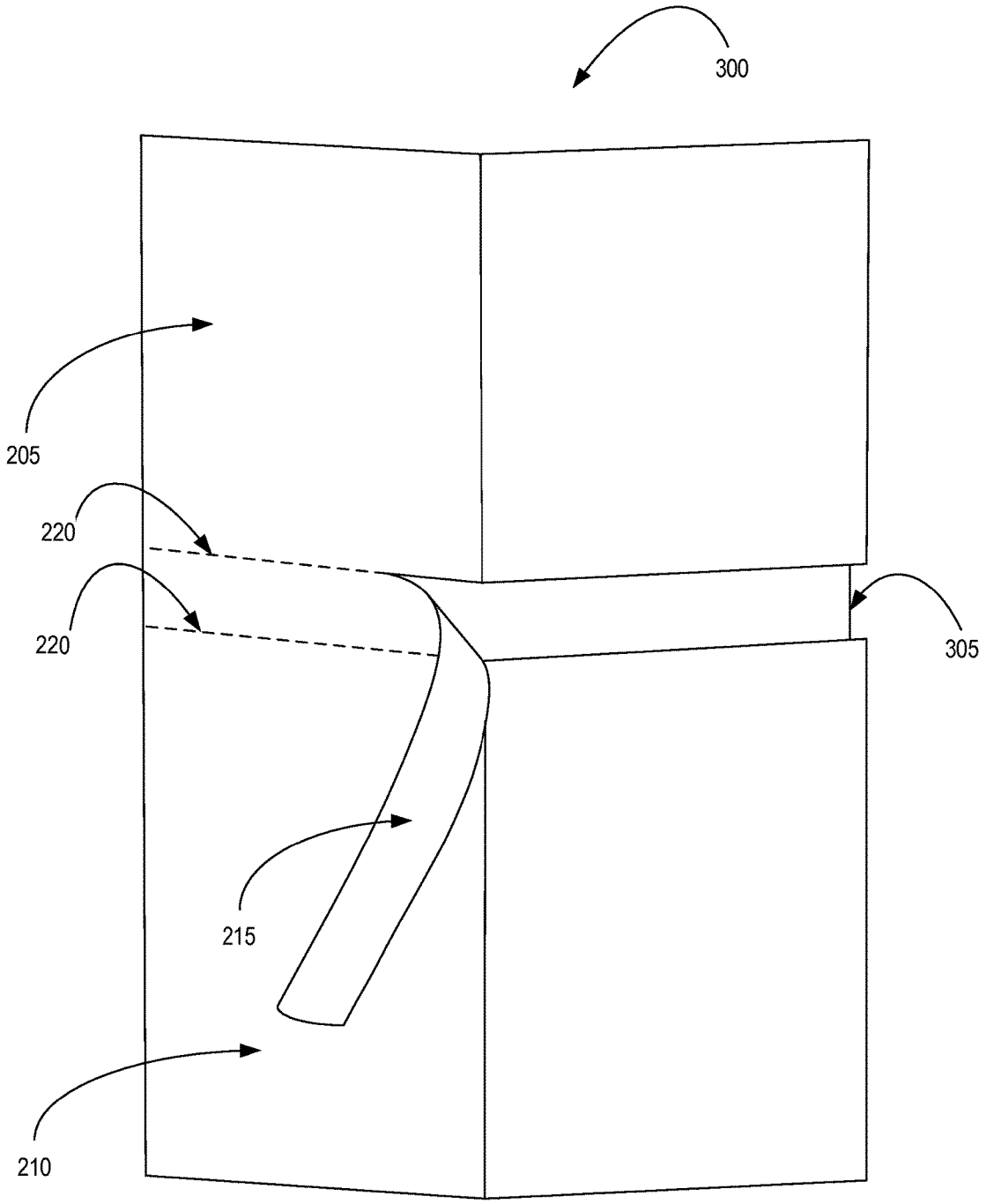
FIG. 3 illustrates an enhanced view of a compartment separation element according to an embodiment of the invention.

FIG. 3 illustrates an enhanced view 300 of a compartment separation element 215 according to an embodiment of the invention. As depicted in FIG. 3, the separation element 215 has been partially separated from the first vessel portion 205 and the second vessel portion 210 along the separation lines 220. In some embodiments, when the separation element 215 is removed (or partially removed), a container 305 or other object disposed within the compartment 200 may be visible. Following the separation of the separation element 215 from the compartment 200, the first vessel portion 205 and second vessel portion 210 can be removed from the container 305.

In some embodiments, the placement of the separation element 215 may be in a different location along the compartment 200 than the location shown in FIG. 3. For example, the separation element 215 may be disposed at one end of the compartment. In such embodiments, the removal of the separation element 215 may result in the creation of a single vessel portion. In such embodiments, the separation element may be a cap at the end of the compartment.

In some embodiments, the separation element 215 may not be a strip of material as shown in FIG. 3. In such embodiments, the separation element 215 be a single separation line 220 along which is the border between the first vessel portion 205 and the second vessel portion 210. In such embodiments, the separation of the first vessel portion 205 from the second vessel portion 210 may be performed by twisting the first vessel portion 205 and the second vessel portion 210 in opposite directions along the separation line 220 resulting a tearing of the separation line 220.

Figure 4:
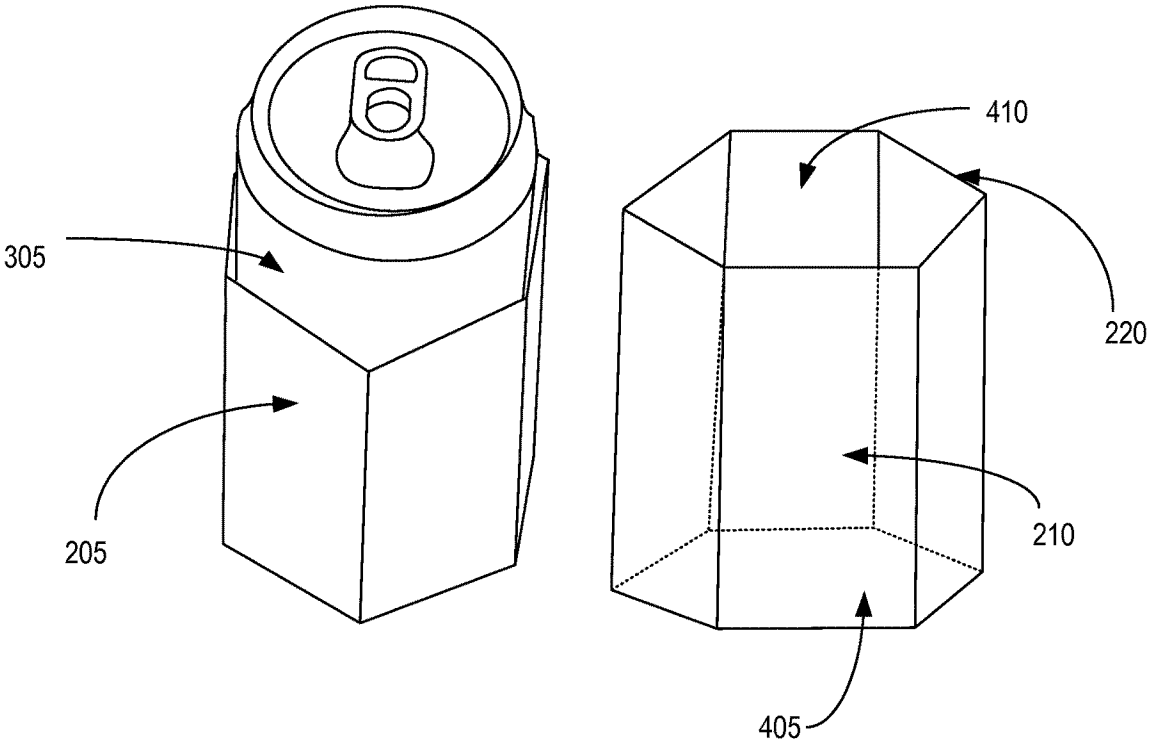
FIG. 4 illustrates a separated compartment according to an embodiment of the invention.

FIG. 4 illustrates a separated compartment according to an embodiment of the invention. In the embodiment shown in FIG. 4, the separation element 215 has been completely separated from the compartment 200 revealing a container 305 disposed with the first vessel portion 205 of the compartment 200. The container 305 is depicted as a cylindrical beverage can. In other embodiments, the container may be formed in any shape capable of placement within the first vessel portion 205 and the second vessel portion 210 of the compartment 200. After separation, the second vessel portion may have a closed end 405 and an opened end 410. In some embodiments, the closed end 405 previously formed the planar surface 115 of FIG. 1. The first vessel portion 205 may also have a closed end and an opened end. The container 305 is depicted as being placed within the opened end of the first vessel portion 205.

In some embodiments, the first vessel portion 205 and the second vessel portion 210 may be manufactured of materials capable of holding fluent materials. First vessel portions 205 and second vessel portions 210 capable of holding fluent materials can be repurposed as cups and used for beverage consumption.

Figure 5:
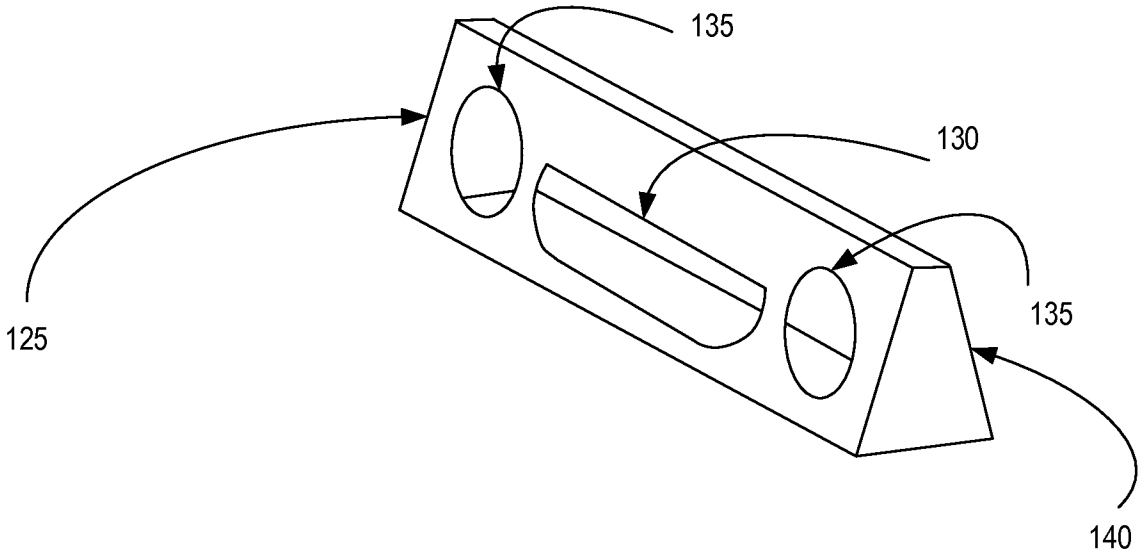
FIG. 5 illustrates an exemplary handle assembly according to an embodiment of the invention.

FIG. 5 illustrates an exemplary handle assembly 125 according to an embodiment of the invention. The handle assembly 125 may attach to the sleeve structure 105, as shown in FIG. 1. In some embodiments, the handle assembly 125 may be glued or otherwise adhered to the sleeve structure 105, and may be detachably coupled to the sleeve structure 105.

In some embodiments, the handle assembly 125 shown in FIG. 5 may serve multiple purposes. For example, the handle assembly 125 may have a hand grip portion 130 to assist with the transportation of the packaging apparatus 100. In addition, the handle assembly 125 may include one or more recess portions 135 that may be utilized to carry objects. For example, the one or more recess portions 135 may be configured to carry one or more balls (e.g., ping-pong balls). In such embodiments, the balls may be used in combination with the first vessel portions 205 and the second vessel portions 210 for various activities.

In some embodiments, the packaging apparatus 100 can be manufactured with a detachable handle assembly 125 allowing the handle assembly 125 to be used as a stand for the balls. In some embodiments, the detached handle assembly 125 can be positioned on a side portion 140 with the hand grip 130 further serving as a channel to store the balls. In some embodiments, the handle assembly 125 can remain attached to the sleeve structure 105 of the packaging apparatus 100.

Figure 6:
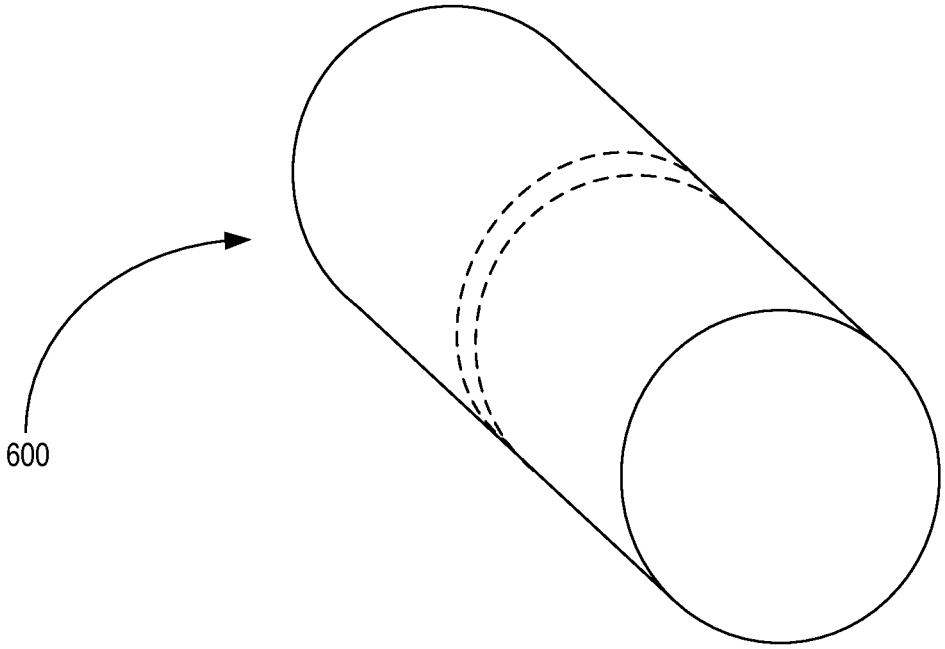
FIG. 6 depicts an alternative compartment configuration according to an embodiment of the invention.

FIG. 6 depicts an alternative compartment configuration 600 according to an embodiment of the invention. The shape and configuration of the compartment 600 is depicted as a cylindrical structure in FIG. 6. However, the shape and configuration of the compartment 600 can take any form as would be understood by one of ordinary skill in the art. In some embodiments, when separated from the packaging apparatus 100, the compartment 600 may also function as an insulating sleeve for the container disposed therein.

Figure 7:
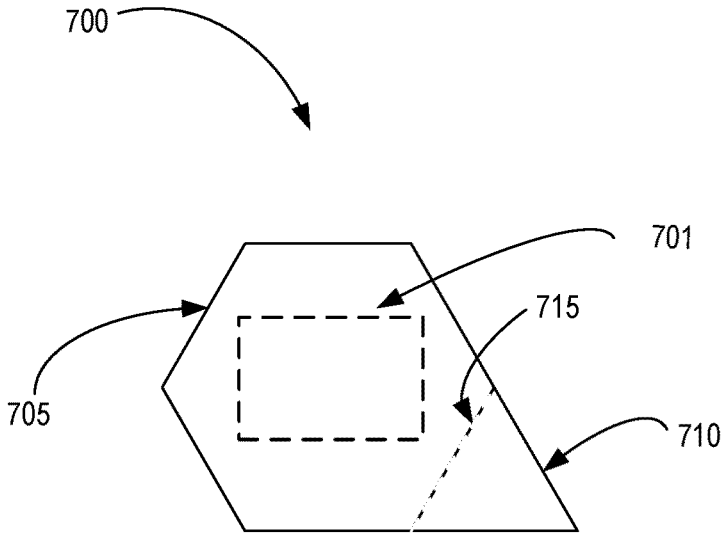
FIG. 7 illustrates an embodiment for a planar surface of a compartment according to an embodiment of the invention.

FIG. 7 illustrates an embodiment for a planar surface 115 of a compartment 700 according to an embodiment of the invention. The shape of the perimeter 705 of the compartment's top or bottom planar surface may be formed in any geometric configuration. As shown in FIG. 7, the shape of the perimeter 705 is a hexagonal shape. Referring back to FIG. 6, the shape of the perimeter may be a circular shape. In some embodiments, the compartments can include a graphic 701 on either the top or the bottom surfaces.

The embodiment shown limits overlap and provides a continuous surface for the packaging apparatus by using a triangular tab 710 to fill any voids in the planar surface formed by ornamental arrangement of the compartments. For example, a packaging apparatus formed into a pyramidal shape may require the inclusion of a plurality of tabs 710. This may also provide a more solid structure to the packaging apparatus 100. A tear line 715 (e.g., a perforated line) can be placed on the apparatus to assist in removing the tab 710 from the compartment.

In some embodiments, the tabs 710 may provide additional functionality in addition to contributing to the planar surface of the packaging apparatus 100. For example, in embodiments where one or more tabs 710 are fixably attached to the closed end 405 of one of the vessel portions, the one or more tabs 710 may provide additional support for the vessel portion for placement on a surface. In addition, the tab may be used by a user for holding the vessel portion or as a point of contact for a game requiring the user to flip the vessel portion from a first orientation to a second orientation.

Figure 8:
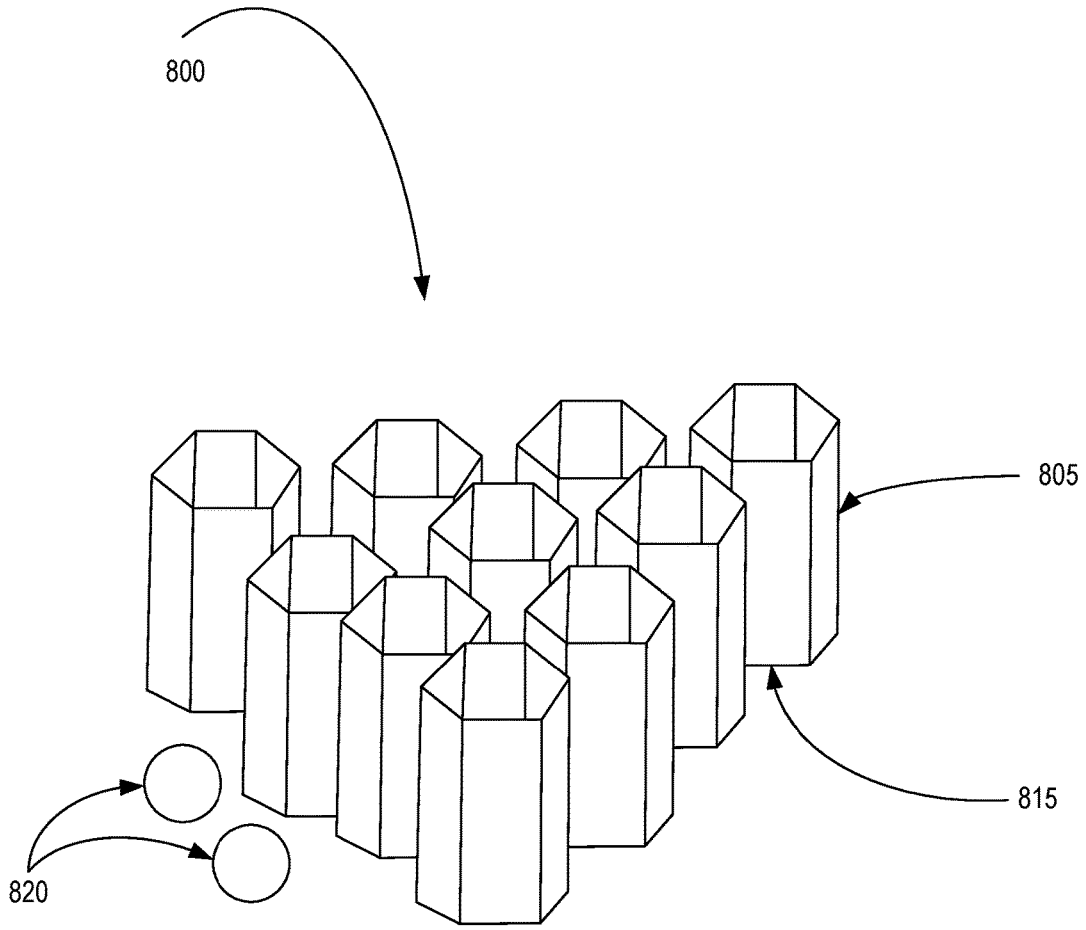
FIG. 8 shows an arrangement of the components of the packaging apparatus according to an embodiment of the invention.

FIG. 8 shows an arrangement 800 of the components of the packaging apparatus according to an embodiment of the invention. FIG. 8 provides a sample embodiment that demonstrates how the vessels of the packaging apparatus can be repurposed to conserve and recycle resources. In FIG. 8, the plurality of compartments have each been separated using the separation element to form a plurality of vessel portions 805. The arrangement 800 includes a two ping-pong balls 820 that can be packaged in the handle assembly. Each of the vessel portions are depicted as being positioned with the closed end 815 disposed on a planar surface (e.g., a table, a countertop, a bench). The particular arrangement of the vessel portions 805 shown in FIG. 8 may facilitate recreational activities using the vessel portions 805 and the ping-pong balls 820.

Figure 9A:
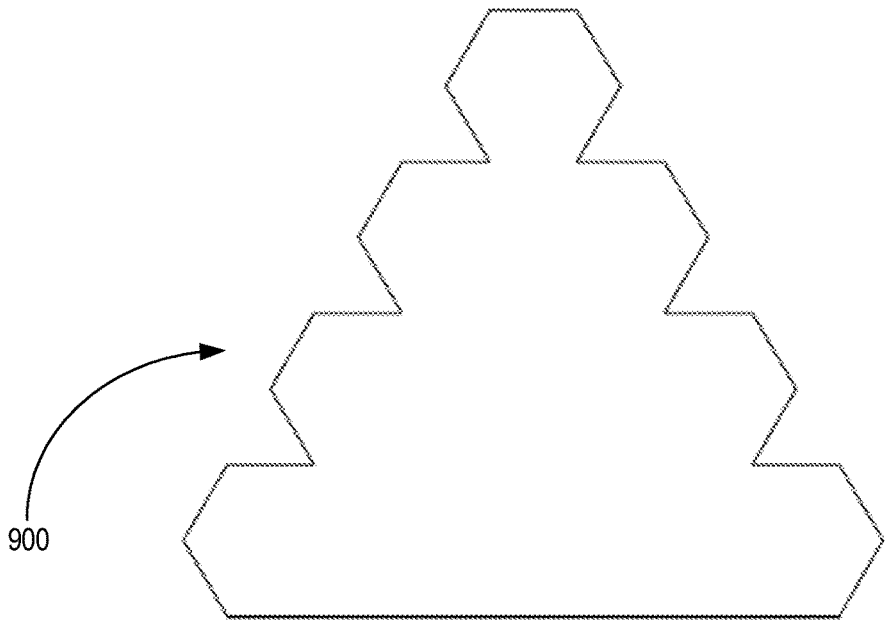
FIGS. 9A and 9B are views of an alternative sleeve structure according to an embodiment of the invention.
Figure 9B:
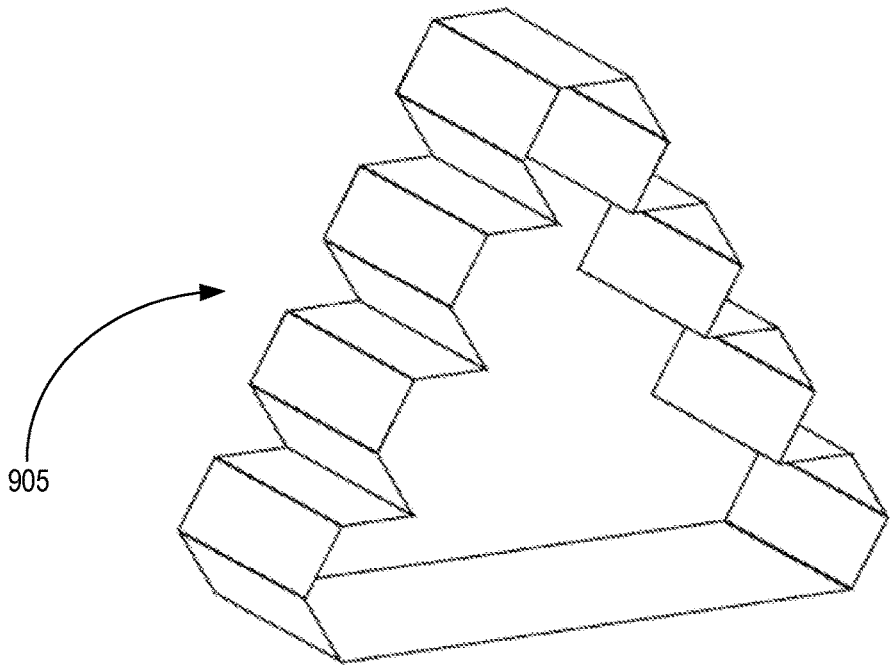

FIGS. 9A and 9B are views of an alternative sleeve structure according to an embodiment of the invention. FIG. 9A is a profile view 900 of a sleeve structure where the sleeve structure is an outline of the shaped formed by the plurality of compartments to be disposed within the sleeve structure. FIG. 9B is a three-quarter view 905 of the same sleeve structure. In such embodiments, the sleeve structure may constructed from a single length of material that may be folded or molded into the particular sleeve structure shape depicted in FIGS. 9A and 9B. In such embodiments, the single length of material may be subsequently sealed or adhered at a particular joining location.

Figure 10A:
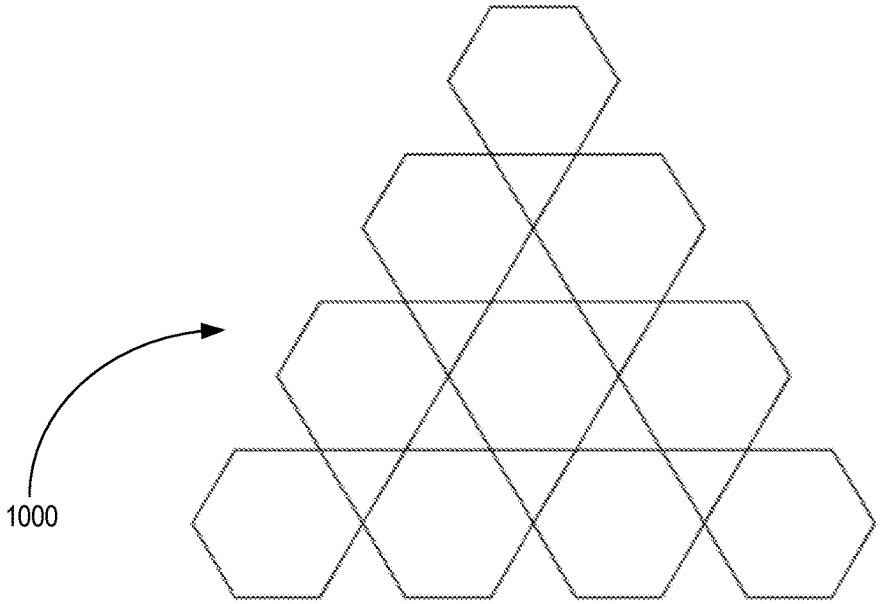
FIGS. 10A and 10B are views of an alternative sleeve structure according to an embodiment of the invention.
Figure 10B:
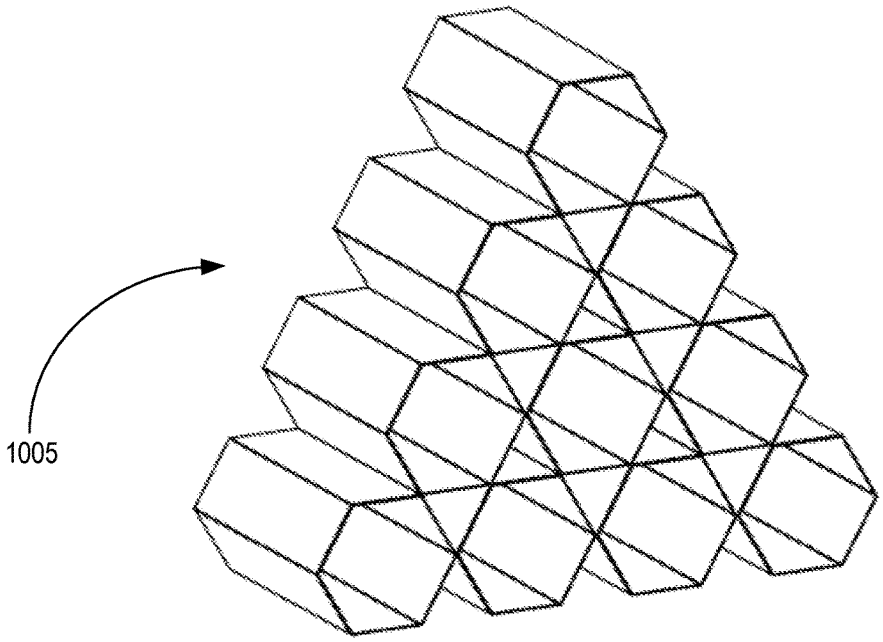

FIGS. 10A and 10B are views of an alternative sleeve structure according to an embodiment of the invention. FIG. 10A is a profile view 1000 of a sleeve structure where the sleeve structure is composed of a plurality of cells where each cell is formed to individually hold one of the plurality of compartments to be disposed within the sleeve structure. FIG. 10B is a three-quarter view 1005 of the same sleeve structure. In some embodiments, each cell of the plurality of cells may be a separate component that is affixed to the other cells to form the sleeve structure depicted in FIGS. 10A and 10B.

The sleeve structures embodiments depicted in FIGS. 9A, 9B, 10A, and 10B are merely exemplary. Additional embodiments may include sleeve structures in other alternative configurations, as would be understood by one of ordinary skill in the art.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

What is claimed is:

1. A packaging apparatus comprising:
- a sleeve structure;
- a plurality of compartments disposed within the sleeve structure, wherein each of the plurality of compartments includes:
  - a first vessel portion,
  - a second vessel portion, and
  - a separation element configured to decouple the first vessel portion from the second vessel portion; and
- a handle assembly affixed to the sleeve structure.

2. The packaging apparatus of claim 1, wherein the separation element includes perforations.

3. The packaging apparatus of claim 1, wherein the separation element includes an adhesive.

4. The packaging apparatus of claim 1, wherein the plurality of compartments each enclose a container that contains a liquid.

5. The packaging apparatus of claim 4, wherein the containers are removable from the respective compartments when the first vessel portions and the second vessel portions are separated.

6. The packaging apparatus of claim 5, wherein the first vessel portions and the second vessel portions are separated by the removal of a separation element.

7. The packaging apparatus of claim 4, wherein the first vessel portions and the second vessel portions are configured to retain the liquid.

8. The packaging apparatus of claim 1, wherein the plurality of compartments are characterized by a geometric cross section.

9. The packaging apparatus if claim 1, wherein at least a portion of the plurality of compartments are in physical contact with one another.

10. The packaging apparatus of claim 1, wherein the sleeve structure comprises a plurality of sleeves, wherein the plurality of compartments are disposed within the plurality of sleeves.

11. The packaging apparatus of claim 1, wherein the sleeve structure is in physical contact with less than all of the plurality of compartments.

12. The packaging apparatus of claim 1, wherein each of the plurality of compartments includes a top surface and a bottom surface, and wherein the top surface and the bottom surface are substantially planar.

13. The packaging apparatus of claim 12, wherein top surfaces of the plurality of compartments are substantially coplanar, and wherein bottom surfaces of the plurality of compartments are substantially coplanar.

14. The packaging apparatus of claim 13, wherein the top surface of the plurality of compartments include a graphic.

15. The packaging apparatus of claim 13, wherein the bottom surface of the plurality of compartments include a graphic.

16. The packaging apparatus of claim 1, wherein the handle assembly comprises a recess portion.

17. The packaging apparatus of claim 16, wherein the handle assembly affixed to the sleeve structure is detachably coupled to the sleeve structure.

18. The packaging apparatus of claim 17, wherein the recess portion of the handle assembly is configurable as a stand for a ball.

* * * * *